US008512060B2

(12) United States Patent
Smith

(10) Patent No.: US 8,512,060 B2
(45) Date of Patent: Aug. 20, 2013

(54) ROTATABLE AND POSITIVE LOCKABLE CIRCULAR CONNECTOR ADAPTER

(75) Inventor: Stanley D. Smith, Santa Rosa, CA (US)

(73) Assignee: Icore International, Inc., Santa Rosa, CA (US)

( * ) Notice: Subject to any disclaimer, the term of this patent is extended or adjusted under 35 U.S.C. 154(b) by 0 days.

(21) Appl. No.: 13/326,789

(22) Filed: Dec. 15, 2011

(65) Prior Publication Data

US 2012/0156911 A1 Jun. 21, 2012

Related U.S. Application Data

(60) Provisional application No. 61/423,422, filed on Dec. 15, 2010.

(51) Int. Cl.
*H01R 13/62* (2006.01)

(52) U.S. Cl.
USPC ..... 439/323; 439/347

(58) Field of Classification Search
USPC ..... 439/201, 204, 312, 320–323, 347, 439/923; 285/91, 92, 119, 276, 281, 282, 285/287
See application file for complete search history.

(56) References Cited

U.S. PATENT DOCUMENTS 4,462,653 A * 7/1984 Flederbach et al. ..... 439/312
5,366,383 A 11/1994 Dearman
5,558,376 A 9/1996 Woehl
5,653,605 A * 8/1997 Woehl et al. ..... 439/321
5,692,918 A * 12/1997 Hill ..... 439/323

* cited by examiner

*Primary Examiner* — Thanh Tam Le
(74) *Attorney, Agent, or Firm* — Craig M. Stainbrook; Stainbrook & Stainbrook, LLP

(57) ABSTRACT

A rotatable and positive lockable circular connector including a spin coupling having an axial bore therethrough; a cylindrical connection interface inserted into the axial bore of the spin coupling; and an adapter body having an internal bore into which the spin coupling is axially inserted, thereby placing the spin coupling, connection interface, and adapter body into axial alignment. The adapter body includes a shielded branch for passing conductor wires. A locking system permits selective rotation of the spin coupling in relation to the adapter body when the apparatus is in an unlocked position, and positively locks the spin coupling in relation to the adapter body when the apparatus is in a locked position. Grounding elements maintain a ground path from the branch shielding to a connector shell coupled to the spin coupling.

15 Claims, 3 Drawing Sheets

ROTATABLE AND POSITIVE LOCKABLE CIRCULAR CONNECTOR ADAPTER

CROSS REFERENCES TO RELATED APPLICATIONS

The present application claims priority of U.S. Provisional Patent Application Ser. No. 61/423,422, filed on Dec. 15, 2010.

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION-BY-REFERENCE OF MATERIAL SUBMITTED ON A COMPACT DISC

Not applicable.

SEQUENCE LISTING

Not applicable.

BACKGROUND OF THE INVENTION

1. Field of the Invention

The present invention relates most generally to electrical conduits, cables, and connectors, and more particularly to a cable connector assembly, and still more particularly to a swiveling circular connector adapter with a positive locking feature. The apparatus is particularly well suited for use in confined spaces in which large numbers of electrical cables converge for organization and sorting through harnesses and other cable organization apparatus and for connection to navigation, communication, and electronics systems connector panels.

2. Background Discussion

Sensors used in the aerospace industry typically have circular connectors that interface with an electrical harness or cable. These circular connectors are not consistently installed in the sensor housings with the master keyway always in the same location. In order to mate the harness connector with the sensor connector, the cable must be bent and twisted, sometimes severely, in an attempt to eliminate the misalignment and mate the two connectors. The twisting shortens the harness length and imparts on the harness a constant stress and tension that greatly shortens the life and reliability of the harness assembly.

U.S. Pat. No. 5,366,383 to Dearman. This patent describes a connector assembly having an internally splined locking ring. It includes a first component rotatable relative to a second component, each having a surface formation shaped to cooperate with surface formation in the locking ring, which is displaceable along the assembly between a first position in which the surface formation on the locking member is out of engagement with at least the surface formation on one of the components so as to allow relative rotation of the two components and a second position in which the surface formation on the locking member engages the surface formations on both the components so as to prevent relative rotation of the components and thereby lock the two components together.

U.S. Pat. No. 5,558,376, to Woehl, teaches a low profile swivel adapter intended to reduce damage to electrical cables in high vibration and flexing environments. The cable extends from a stable platform into a sidearm lying at an angle to the length of the cable. The cable is rigidly held in the sidearm and enters a main body of the connector at an angle where a U-shaped bend is developed. It then extends along an essentially linear path to a connector on the vibrating body. The connector includes a threaded retaining bearing that couples the stationary main body of the swivel to an internally threaded front member that is rotatable relative to the main body.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described herein.

BRIEF SUMMARY OF THE INVENTION

The present application describes an adjustably rotatable circular connector adapter with a positive locking feature. The invention allows a circular connector installed on the rotatable adapter of a wiring harness to be rotated into a substantially precisely correct alignment of the master keyways of both connectors. Once the rotatable adapter of the present invention is rotated into an aligned position, the harness can be positioned (aligned with clamping points and the like) and this position can then be locked in place. Not only does the locking ring lock the harness position, but it also locks the spin coupling so that it cannot rotate and the circular connector cannot come loose.

It will be seen that the present invention is a connector adapter that maintains continuous conductivity between the teeth of a connection interface and the adapter body exterior, which is coupled to the shielding braid of an electrical harness or cable. Integral swivel stops are located radially around the axis of rotation and can be manufactured to any desired angle up to slightly less than 360°. The front spin coupling has internal female threads that mate to the external male rear accessory threads of the circular connector and provide a row of external splines. The adapter body provides a row of external splines of complementary tooth count and shape. Axially disposed over the exterior of the spin coupling is an internally splined locking ring that is slidable along the assembly into a locking position where the splines on the ring engage the splines on both the rotatable spin coupling and adapter body so that the relative rotation of the parts is prevented.

The foregoing summary broadly sets out the more important features of the present invention so that the detailed description that follows may be better understood, and so that the present contributions to the art may be better appreciated. There are additional features of the invention that will be described in the detailed description of the preferred embodiments of the invention which will form the subject matter of the claims appended hereto.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein.

LEGEND

Figure 1:
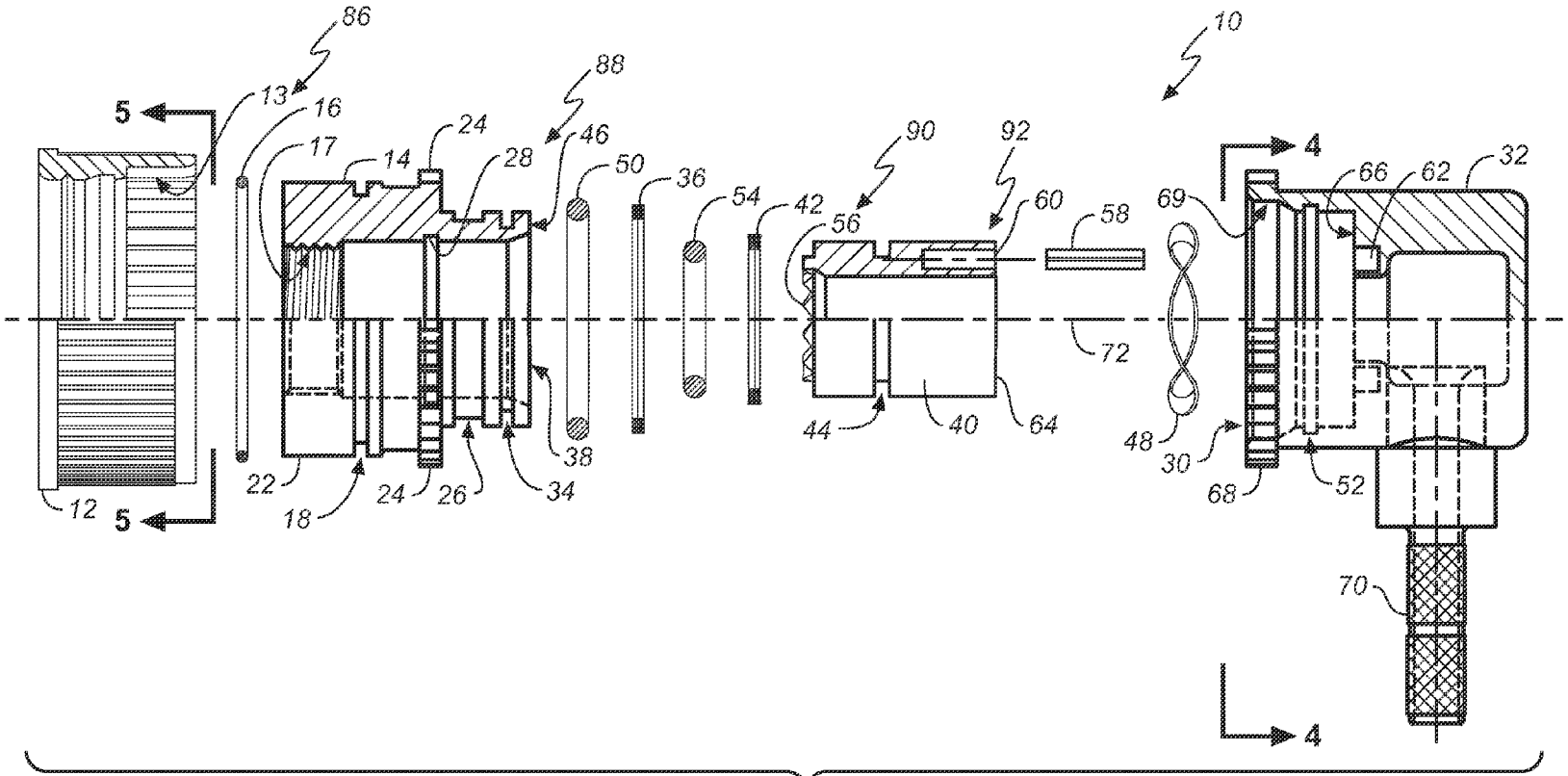
FIG. 1 is an exploded side view in elevation of the swiveling and positive lockable connector assembly of the present invention.

10 rotatable and positive lockable circular connector/adapter
12 locking ring
13 internal splines of locking ring
14 spin coupling
16 round retaining ring
18 groove (first) for round retaining ring 16
17 internal threads of spin coupling 14
22 surface of spin coupling over which locking ring 12 slides
24 row of external splines (or gear teeth)
26 land for O-ring
30 internal bore of adapter body 32
32 adapter body
34 groove (second) to accommodate retaining rings 36
36 retaining rings
38 internal bore
40 connection interface 40
42 retaining rings
44 groove on connection interface in which retaining rings 42 are disposed
46 rear flat surface of spin coupling
48 wave washer
50 O-ring (first)
52 internal groove
54 O-ring (second)
56 annular set of (clocking) teeth
58 locking pin
60 hole aligned with root of one of clocking teeth
62 annular groove for locking pin travel
64 pinned end of connection interface
66 bottom face of internal bore 30
68 external splines (or gear teeth) on adapter body
69 internal land
70 lateral branch
72 longitudinal axis of connector assembly
80 alternative embodiment of adapter body
82 adapter body
84 axially disposed conduit
86 first end of spin coupling
88 second end of spin coupling
90 first end of connection interface
92 second end of connection interface

DETAILED DESCRIPTION OF THE INVENTION

Referring to FIGS. 1 through 5, wherein like reference numerals refer to like components in the various views, there is illustrated therein a new and improved swiveling and positive lockable circular connector adapter, generally denominated 10 herein.

The first structural element of interest is the locking ring 12, which may be fabricated from any of a number of suitable materials, including plastic if weight savings are paramount. The locking ring includes internal gear teeth or splines 13 and is attached to a generally cylindrically shaped spin coupling 14 via a corrosion resistant stainless steel ("CRES") round retaining ring 16.

Round CRES retaining ring 16 fits in a groove 18 on the exterior surface of the spin coupling 14 and fastens the locking ring 12 to the spin coupling 14 and allows the locking ring to slide axially and to remain in the locked position. In the locked position, a fair amount of manual force must be applied to it for it to be unlocked.

Spin coupling 14 has internal threads 17 that threadably mate with the accessory threads on the exterior of a circular connector (not shown but well known in the art). It has an exterior groove 18 for the round retaining ring 16 and a surface 22 over which the locking ring 12 slides. It also has a row of external gear teeth or splines 24 that comprise a portion of the locking system, and a land 26 for an O-ring 50 that seals to the internal bore 30 of an adapter body 32. Still further it has a groove 34 to accommodate two flat CRES retaining rings 36, and an internal bore 38 that accommodates the connection interface 40 and two CRES retaining rings 42 disposed in a groove 44 on the connection interface 40. The rear flat surface 46 has very smooth finish as this is the mating surface for the CRES wave washer 48 which is installed over a generally cylindrical connection interface 40 which is axially installed in the spin coupling, and the both are installed under compression into the adapter body 32, described fully below.

O-ring 50 provides a moisture and dirt seal between the spin coupling 14 and the adapter body 32.

CRES flat retaining rings 36, are installed in an exterior groove 34 in the spin coupling 14 and permanently attach the spin coupling 14 to the adapter body 32 when urged into a groove 52 in the internal bore 30 of the adapter body 32.

O-ring 54, provides a moisture and dirt seal for the rear accessory features of the circular connector to the adapter assembly.

CRES flat retaining rings 42, are installed in an exterior groove 44 in the connection interface 40 and permanently attach the connection interface 40 to the spin coupling 14 when urged into a groove 28 in the internal bore 38 of the spin coupling 14.

On a first end, connection interface 40 has an annular set of (clocking) teeth 56 with the proper angle and number of teeth to mate with appropriate circular connectors (not shown). It houses the CRES rolled locking pin 58 which is pressed into a hole 60 aligned with the root of one of the clocking teeth on the opposite end to aid in proper alignment of the circular connector master keyway. The CRES rolled locking pin 58 travels in an annular groove 62 in the adapter body which together function as the stop mechanism.

CRES wave washer 48 fits over the pinned end 64 of the connection interface 40, and is compressed between a face 46 of the spin coupling 14 and the bottom face 66 of the internal bore 30 of the adapter body 32. Its main function is to complete the ground path from the circular connector shell to the cable shielding braid 71, which is permanently attached to the lateral branch 70 on the adapter body 32.

Adapter body 32, can be generally straight or of an angular configuration, depending on the geometry of the application. Proximate the end into which spin coupling and connection interface are inserted, it includes an annular row of axially disposed external gear teeth or splines 68 which have a tooth profile that matches that of the splines or gear teeth 24 on spin coupling 24, and which cooperate with the locking ring to provide the locking system of the present invention. It includes a circular groove 62 in the bottom (or end) of the bore that can be configured at different angles to position the swivel stops, an internal land 69 for a sealing O-ring 50, an internal groove for accepting the two CRES flat retaining rings 36 that fasten the spin coupling 14, and a flat bottom face 66 that interfaces with the CRES wave washer 48 for conduction continuity.

Figure 2A:
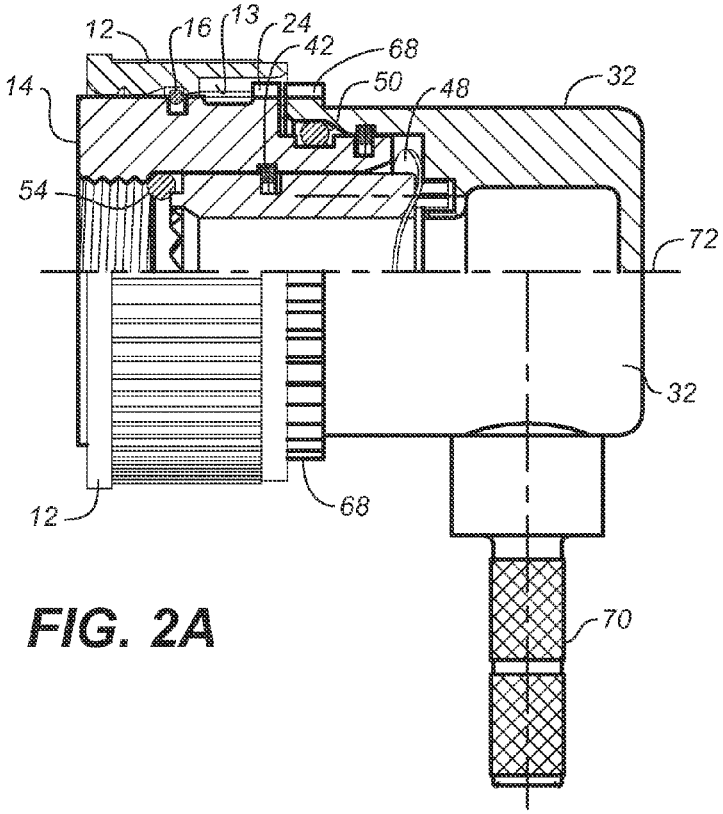
FIG. 2A is a partially exploded side view in elevation thereof, showing the assembly in the unlocked and rotatable position.
Figure 2B:
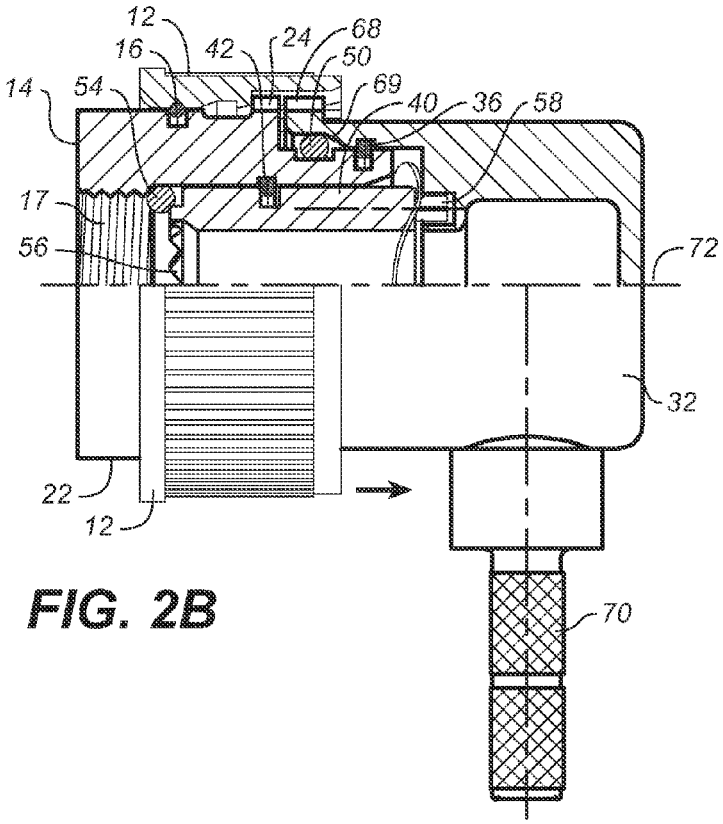
FIG. 2B is a partially exploded side view in elevation thereof, showing the assembly in the locked position.
Figure 5:
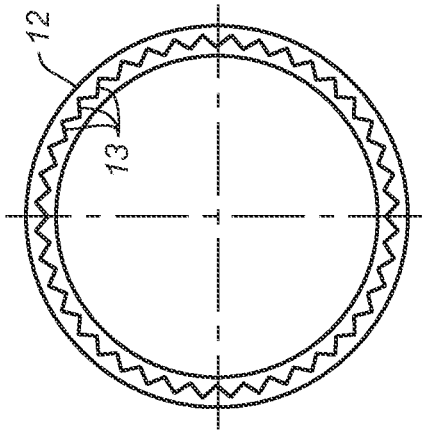
FIG. 5 is an end view of the locking ring of FIG. 1 shown along lines 5-5.
Figure 4:
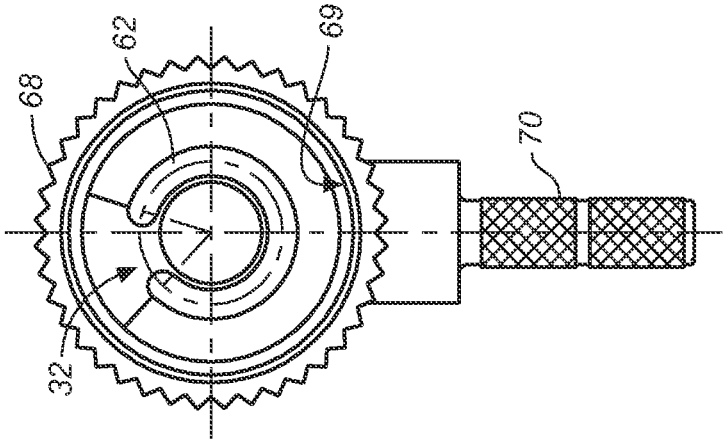
FIG. 4 is an end view of the adapter body of FIG. 1 shown along lines 4-4.
Figure 3:
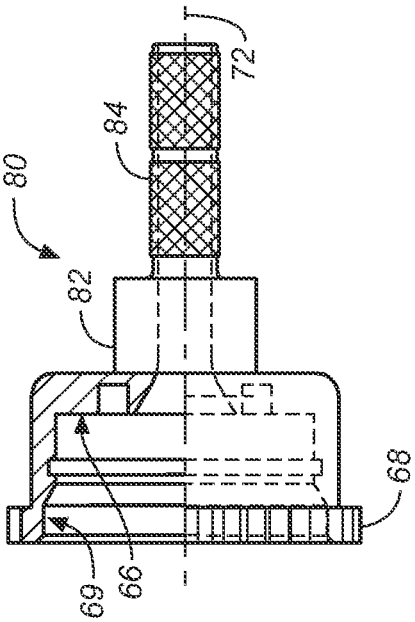
FIG. 3 is a partial cross sectional view in elevation of an alternative adapter body configuration.

Adapter body 32 further includes a lateral branch 70 through which cable or conductor wires are passed. The lateral branch is disposed normal relative to the longitudinal axis 72 of the entire assembly. As shown in FIG. 3 only, in an alternative embodiment 80, adapter body 82 may have an axially disposed conduit 84 for passing conductors. It is, however, in the first preferred embodiment that the great advantages of this invention are fully appreciated. Cables, conductors, conduits and the like converge on connector panels at inconvenient angles and must frequently be bent (to whatever degree possible) to be properly aligned with the connector. To avoid undue stress on the structures from bending and flexion, sufficient space for the alignment may entail the provision of a considerable volume of space apart from the connector panel wall. Even with such space, it is greatly advantageous to have a connector that facilitates connection very close to the connector panel and at any angle necessary to reduce or altogether eliminate stress on the electric cable proximate the connector. This is accomplished with the rotatable and positive lockable connector adapter of the present invention. Reference to FIGS. 2A-2B shows that even slight cable entry angle changes can be achieved simply by sliding locking ring axially to uncover splines 68 on adapter body 32, such that adapter body can rotate in relation to spin coupling 14 and position lateral branch 70 at nearly any chosen angle. Adjustability is effectively unlimited within a range of slightly less than 360° of rotation about the longitudinal axis of the connector assembly, this limitation owing to the range offered by annular groove 62.

From the foregoing, it will be clear that the inventive rotatable and positive lockable circular connector 10 includes three primary elements, including the spin coupling 14, the connection interface 40, and the adapter body 32. The spin coupling has a first end 86 and a second end 88, and an internal bore 38 in its second end 86 sized to accommodate the substantially cylindrical exterior surface of a first end 88 of the connection interface, which inserts into the spin coupling internal bore and is retained therein through retaining rings 42 which are urged into an internal groove 28 therein. Once installed in the spin coupling, a second end 90 of the connection interface extends slightly from the second end 88 of the spin coupling and presents a locking pin 58 extending from its second end 92 that will be inserted into an annular groove 62 in the adapter body. Further, clocking teeth 56 are brought into a mating relationship with complementary teeth on a circular cable connector end. A portion of the spin coupling, extending to the external splines 24, is then inserted into an internal bore 30 in the adapter body 32 and is retained therein by retaining rings 36 urged into a groove 52 therein. When so installed, the locking pin is captured and guided by groove 62, the primary bodies are axially aligned, and the rows of external splines on the spin coupling and adapter body, 24 and 68, respectively, are adjacent and closely spaced. In this configuration, locking ring 12 can be axially translated (slided) back and forth such that its internal splines can selectively cover only external splines 24 on the spin coupling (FIG. 2A), in which event the apparatus is in an unlocked configuration and the adapter body can be rotated to adjust the angle of lateral branch 70 in relation to the end of a cable connector threadably screwed into the first end 86 of spin coupling 14; or both sets of external splines (FIG. 2B); or it can be moved into the positive locked position (FIG. 2B), in which event the adapter body cannot be rotated in relation to the cable connector.

Still further, from the foregoing, it will be seen that it its most essential aspect, the present invention is a rotatable and positive lockable circular connector that includes (1) a spin coupling having a first end and a second end, and an axial bore therethrough; (2) a connection interface having a first end and a second end, wherein the first end is inserted into the second end of the spin coupling; and (3) an adapter body having an axially oriented internal bore into which the second end of the spin coupling is axially inserted. The insertions place the spin coupling, connection interface, and adapter body into axial alignment. The adapter body includes a branch for passing conductor wires, the branch having braided cable shielding. A locking system permits the selective rotation of the spin coupling in relation to the adapter body when the apparatus is in an unlocked position, and positively locks the spin coupling in relation to the adapter body when the apparatus is in a locked position. Finally, the apparatus includes grounding elements for maintaining a ground path from the cable shielding braid to a connector shell coupled to the first end of the spin coupling.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A connector adapter, comprising:

a spin coupling having a first end and a second end, an axial bore through said spin coupling with cable connection structure in said axial bore proximate said first end, and connection interface retaining features in said axial bore proximate said second end, and further including a movable locking element disposed proximate said first end, a fixed locking feature disposed around the exterior of said spin coupling, and retaining elements on said second end;

a generally cylindrical connection interface having a first end for insertion into said second end of said spin coupling, and further including retaining elements on said first end, and a stop element disposed on said connection interface second end;

an adapter body having an internal bore into which said spin coupling and said connection interface are inserted, said adapter body including fixed locking features disposed proximate the opening of said internal bore that cooperate with said fixed locking features and said movable locking element on said spin coupling, a stop feature disposed in the end of said internal bore which cooperates with said stop element of said interface connector, retaining structure disposed in said internal bore for cooperating with said retaining features on said second end of said spin coupling, and an external branch to which a cable shield braid is permanently attached;

electrical conductivity continuity element disposed between said connection interface and said adapter body; and wherein when said connection interface is inserted into said internal bore of said spin coupling, and said spin coupling is then inserted into said adapter body, said fixed locking features on said spin coupling and said adapter body cooperate with said movable locking element on said spin coupling to provide a positive locked configuration that prevents rotation of said adapter body in relation to said spin coupling while completing a ground path between a cable connector shell attached to said spin coupling and said cable shielding braid on said branch, and an unlocked rotatable configuration which permits rotation of said adapter body in relation to said spin coupling in a range defined by said stop feature and said stop element.

2. The connector adapter of claim 1, wherein said cable connection structure in said axial bore of said spin coupling comprises female threads for matching male threads of the cylindrical cable connection shell.

3. The connector adapter of claim 1, wherein said connection interface retaining features in said axial bore of said spin coupling comprises at least one retaining ring groove, and said retaining elements on said first end of said connection interface comprise at least one connection interface retaining ring disposed in a groove on said connector adapter, such that when said connection interface is inserted under compression into said spin coupling, said at least one connection interface retaining ring is capture in said at least one retaining ring groove.

4. The connector adapter of claim 1, wherein said fixed locking features disposed around the exterior of said spin coupling comprises an annular row of splines, said fixed locking features disposed proximate the opening of said internal bore of said adapter body comprises an annular row of splines having a tooth profile matching that of the tooth profile of said splines in said annular row of splines on said spin coupling, and where said movable locking element comprises a locking ring that moves axially along said spin coupling to selectively cover either one or both of said fixed locking features on said spin coupling and said adapter body.

5. The connector adapter of claim 1, wherein said stop element disposed on said connection interface second end comprises a locking pin, and wherein said stop feature disposed in the end of said internal bore of said adapter body is an annular groove which receives said locking pin and guides it when said apparatus is in an unlocked configuration and said spin coupling is rotated in relation to said adapter body.

6. The connector adapter of claim 1, wherein said electrical conductivity continuity element comprises an electrically conductive washer disposed over the second end of said connection interface and compressed between a rear face of said spin coupling and a bottom face of said internal bore of said adapter body.

7. The connector adapter of claim 6, wherein said washer is a corrosion resistant stainless steel wave washer.

8. The connector adapter of claim 1, wherein said retaining elements disposed on said second end of said spin coupling comprises at least one retaining ring disposed in a groove surrounding said spin coupling, and said retaining structure disposed in said internal bore of said adapter body comprises at least one groove which captures said at least one retaining ring on said spin coupling when said spin coupling is inserted under compression into said adapter body.

9. The connector adapter of claim 1, wherein said branch is a lateral branch disposed generally normal to the longitudinal axis of the connector adapter assembly.

10. The connector adapter of claim 1, wherein said branch extends from said adapter body along the longitudinal axis of the connector adapter assembly.

11. The connector adapter of claim 1, wherein said movable locking element is a locking ring having internal splines and is attached to said spin coupling with a retaining ring, such that force must be applied to said locking ring to translate it axially from said locked position to said unlocked position.

12. The connector adapter of claim 1, further including a moisture and dirt seal between said spin coupling and said adapter body.

13. The connector adapter of claim 12, wherein said moisture and dirt seal comprises an O-ring disposed on an external land circumscribing a portion of said second end of said spin coupling, and disposed between an internal land in said internal bore of said adapter body and said external land when said connector adapter is assembled.

14. The connector adapter of claim 1, wherein said first end of said connection interface includes an annular set of teeth for mating with a complementary set of teeth on a cable connector end.

15. A rotatable and positive lockable circular connector, comprising:

a spin coupling having a first end and a second end, and an axial bore therethrough;

a connection interface having a first end and a second end and inserted into said second end of said spin coupling;

an adapter body having an axially oriented internal bore into which said second end of said spin coupling is axially inserted, thereby placing said spin coupling, said connection interface and said adapter body into axial alignment when assembled, and further including a branch for passing conductor wires, said branch having a cable shielding braid permanently attached;

a locking system permitting selective rotation of said spin coupling in relation to said adapter body when in an unlocked position and positively locking spin coupling in relation to said adapter body when in a locked position.

* * * * *